US008262046B1

(12) United States Patent
Elrod et al.

(10) Patent No.: US 8,262,046 B1
(45) Date of Patent: Sep. 11, 2012

(54) COLLAPSIBLE WORKPIECE SUPPORT APPARATUS

(76) Inventors: Derek M. Elrod, Oak Grove, MO (US); Penelope Elrod, Oak Grove, MO (US)

( * ) Notice: Subject to any disclaimer, the term of this patent is extended or adjusted under 35 U.S.C. 154(b) by 443 days.

(21) Appl. No.: 12/632,104

(22) Filed: Dec. 7, 2009

(51) Int. Cl.
*A47F 5/00* (2006.01)

(52) U.S. Cl. ..... 248/354.5; 248/165; 248/166; 108/35; 108/115; 269/37

(58) Field of Classification Search ..... 248/165–167, 248/170–173, 200.1, 354.1, 354.5; 269/16, 269/37, 55, 71, 289 R, 329; 108/65, 69, 108/99, 115, 116, 121, 123, 144.11, 147.19, 108/147.2, 147.21; D6/474
See application file for complete search history.

(56) References Cited

U.S. PATENT DOCUMENTS

| | | | | |
|---|---|---|---|---|
| 4,128,234 | A | 12/1978 | McKee | |
| 5,078,056 | A * | 1/1992 | McCauley | 108/115 |
| 5,645,272 | A | 7/1997 | Brennan, Sr. | |
| 6,523,319 | B2 * | 2/2003 | Bockhorn et al. | 52/651.01 |
| 6,581,921 | B2 | 6/2003 | Griggs | |
| 6,779,466 | B2 * | 8/2004 | Shabram, Jr. | 108/35 |
| 6,863,270 | B2 | 3/2005 | Bartley, Jr. | |
| 6,883,881 | B2 * | 4/2005 | Gauss | 312/237 |
| 7,112,026 | B1 * | 9/2006 | Foster | 414/10 |
| 2006/0273702 | A1 | 12/2006 | Espindola et al. | |
| 2009/0008849 | A1 | 1/2009 | Cunningham | |

FOREIGN PATENT DOCUMENTS

GB 2398755 A * 9/2004

* cited by examiner

*Primary Examiner* — Gwendolyn Baxter

(57) ABSTRACT

The collapsible work piece support apparatus provides vertical workpiece support of cabinets drywall and other objects needing support prior to and during installation and removal. The apparatus provides adjustable height in supporting the workpiece by way of the telescoping legs. Horizontal support of the workpiece is provided by virtue of the stabilizing blocks that are hingedly stored within cutouts in the horizontal members. Importantly, the apparatus is collapsible and thereby easily transported and stored. The basic design and structure of the apparatus contributes to ease of use. The overall design and structural integrity, as well as basic structure, easily provide for a single worker to support needed workpieces.

9 Claims, 6 Drawing Sheets

COLLAPSIBLE WORKPIECE SUPPORT APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

In construction, various objects must often be supported prior to fastening to ceilings and to walls, for example. Quite often, more than one individual must be employed in order to support objects prior to and during fastening or even removal. Cabinet installation is an excellent example wherein one worker cannot efficiently support and affix cabinets to a wall or ceiling. Size and weight of cabinets testify further to difficulty. Various devices have been proposed for assisting in such tasks. Some such devices can support only one cabinet at a time, yet it is advantageous for a worker to support and assemble multiple cabinets prior to fastening them. Such a procedure allows lifting and supporting of one cabinet section at a time, adding and supporting other cabinet sections, assembling the cabinets sections, and fastening the assembled cabinets to the given structure.

A properly designed device should incur minimal production costs, be easily used by one person, provide height adjustment for cabinet positioning, and prevent horizontal movement of the supported cabinets. An ideal device should collapse for portability and space savings and should be lightweight to aid in portability and ease of use. The present apparatus fulfills these needs.

FIELD OF THE INVENTION

The collapsible workpiece support apparatus relates to devices for supporting workpieces and more especially to an apparatus that provides vertical and horizontal support of a workpiece, such as cabinets, while further providing height adjustment in positioning the workpiece.

SUMMARY OF THE INVENTION

The general purpose of the collapsible workpiece support apparatus, described subsequently in greater detail, is to provide a collapsible workpiece support apparatus which has many novel features that result in an improved collapsible workpiece support apparatus which is not anticipated, rendered obvious, suggested, or even implied by prior art, either alone or in combination thereof.

To attain this, the collapsible workpiece support apparatus provides vertical workpiece support of cabinets, drywall and other objects needing support prior to and during installation and removal.

The apparatus provides adjustable height in supporting the workpiece by way of the telescoping legs. Horizontal support of the workpiece is provided by virtue of the stabilizing blocks that are hingedly stored within cutouts in the horizontal members. Importantly, the apparatus is collapsible and thereby easily transported and stored. The apparatus is mechanically basic in order to reduce production and sales costs and to further contribute to light weight. The basic design and structure of the apparatus also contributes to ease of use. The overall design and structural integrity, as well as basic structure, easily provide for a single worker to support needed workpieces.

While the apparatus may be made of wood, composites, or metals, the ideal embodiment is comprised of plasticized material for strength and lightest weight, as portability is critical to a one-man user.

A more basic embodiment of the apparatus may include only the upper support and base, with three telescopic legs hingedly supporting the upper support. Stabilizing blocks are hinged to the upper support and provide lateral stabilization with the upper support elevation from the collapsed state to the workpiece supportive state.

Thus has been broadly outlined the more important features of the improved collapsible workpiece support apparatus so that the detailed description thereof that follows may be better understood and in order that the present contribution to the art may be better appreciated.

An object of the collapsible workpiece support apparatus is to provide vertical workpiece support.

Another object of the collapsible workpiece support apparatus is to provide adjustable height in supporting a workpiece.

A further object of the collapsible workpiece support apparatus is to provide horizontal support of a workpiece.

An added object of the collapsible workpiece support apparatus is to allow a single worker to operate the apparatus and support given workpieces prior to and during installation of the workpiece to a given object.

And, an object of the collapsible workpiece support apparatus is to be mechanically basic.

A further object of the collapsible workpiece support apparatus is to be lightweight.

Still another object of the collapsible workpiece support apparatus is to be highly portable.

And, an object of the collapsible workpiece support apparatus is to be collapsible.

These together with additional objects, features and advantages of the improved collapsible workpiece support apparatus will be readily apparent to those of ordinary skill in the art upon reading the following detailed description of presently preferred, but nonetheless illustrative, embodiments of the improved collapsible workpiece support apparatus when taken in conjunction with the accompanying drawings.

In this respect, before explaining the current embodiments of the improved collapsible workpiece support apparatus in detail, it is to be understood that the collapsible workpiece support apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved collapsible workpiece support apparatus. It is therefore important that the claims be regarded as including such equivalent constructions insofar as they do not depart from the spirit and scope of the collapsible workpiece support apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the collapsible workpiece support apparatus generally designated by the reference number 10 will be described.

Figure 1:
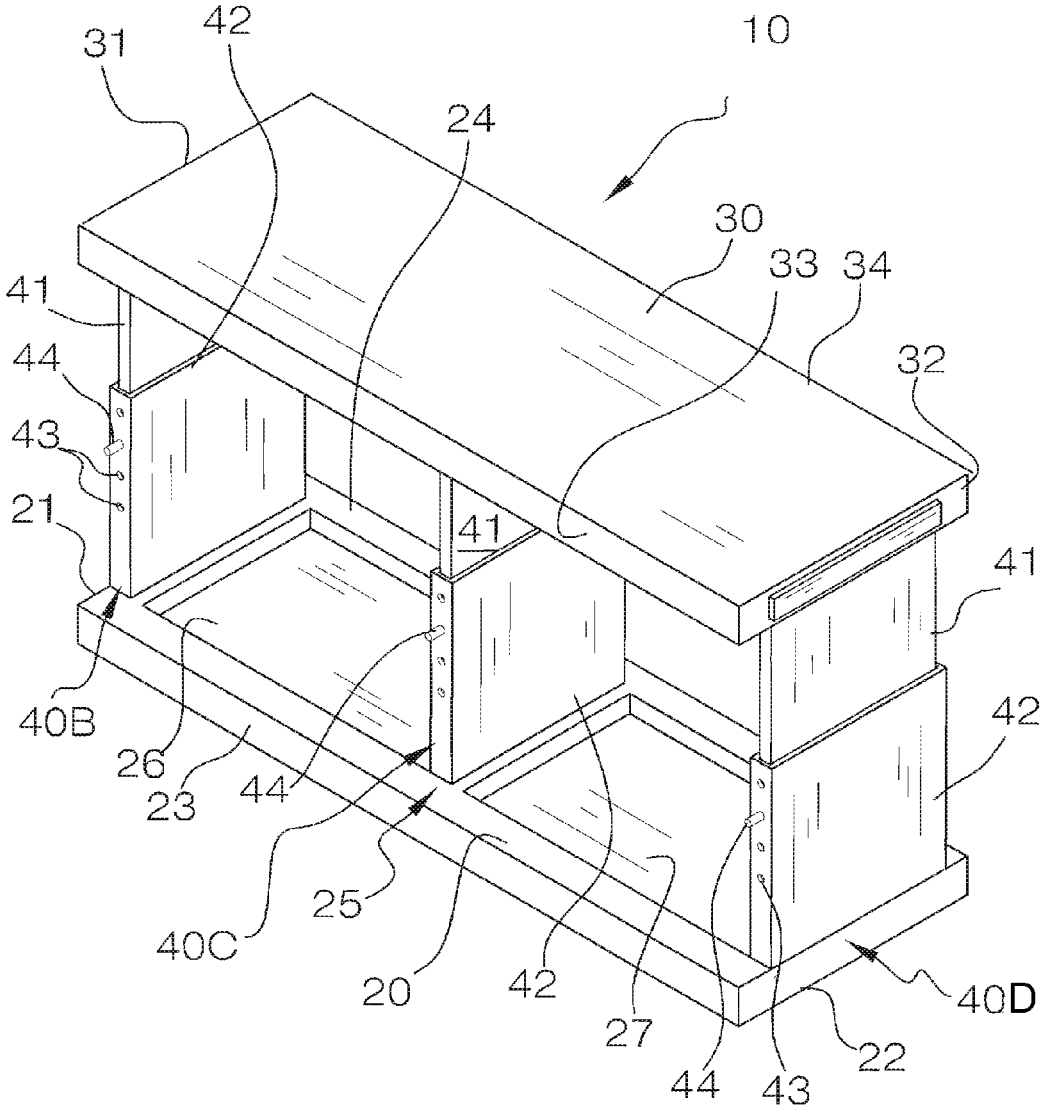
FIG. 1 is a frontal perspective view, the upper support horizontal, with the base, the second, third, and fourth legs in a vertical state.

Referring to FIG. 1, the apparatus 10 partially comprises the rectangular horizontal base 20 having a first end 21 spaced apart from the second end 22. The front 23 is spaced apart from the rear 24. The base 20 further comprises the center 25. The first recess 26 is disposed within the base 20. The first recess 26 is disposed between the center 25 and the first end 21. The second recess 27 is disposed within the base 20. The second recess 27 is disposed between the center 25 and the second end 22. The notch 28 is disposed within the base 20 first end 21. The rectangular horizontal upper support 30 has a support first end 31 spaced apart from the support second end 32. The support front 33 is spaced apart from the support rear 34. The support first end 31 is coplanar with the base 20 first end 21. The support second end 32 is coplanar with the base 20 second end 22.

The support front 33 is coplanar with the base 20 front 23. The support rear 34 is coplanar with the base 20 rear 24. The upper support 30 is therefore of like size to the base 20.

Figure 2:
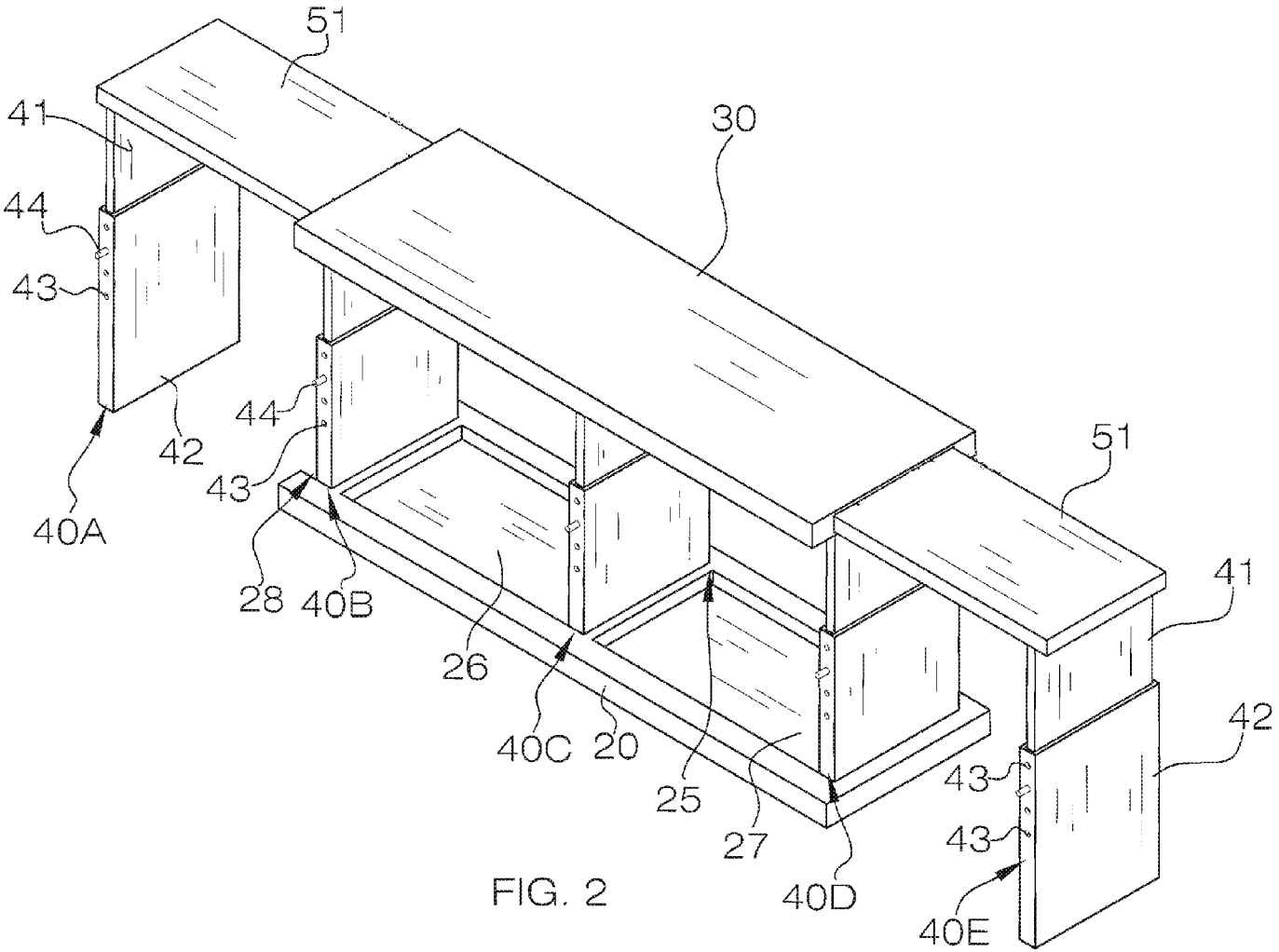
FIG. 2 is a perspective view with both horizontal members slid laterally from the upper support and all legs disposed vertically.

Referring to FIG. 2, the quintet of telescopic legs is provided for supporting the upper support 30 above the base 20. The legs comprise the first leg 40A, the second leg 40B, the third leg 40C, the fourth leg 40D, and the fifth leg 40E. The second leg 40B, the third leg 40C, and the fourth leg 40D attach the base 20 to the upper support 30. Each of the second leg 40B, third leg 40C, and fourth leg 40D hingedly attach to the base 20 and to the upper support 40 via one leg hinge 45 on the base 20 and one leg hinge 45 on the upper support 30. Each telescoping leg comprises an inner member 41 slideably disposed within an outer member 42. Each telescoping leg has a leg length 46 from proximal to the base 20 front 23 and support front 33 to proximal to the base 20 rear 24 and support rear 34. The legs comprise the second leg 40B disposed adjacent to the base 20 first end 21 and the support first end 31. The second leg 40B is selectively pivoted outwardly in the base 10 notch 28. The third leg 40C is disposed at the base 20 center 25. The fourth leg 40D is disposed proximal to the base 20 second end 22 and the support second end 32.

Figure 3:
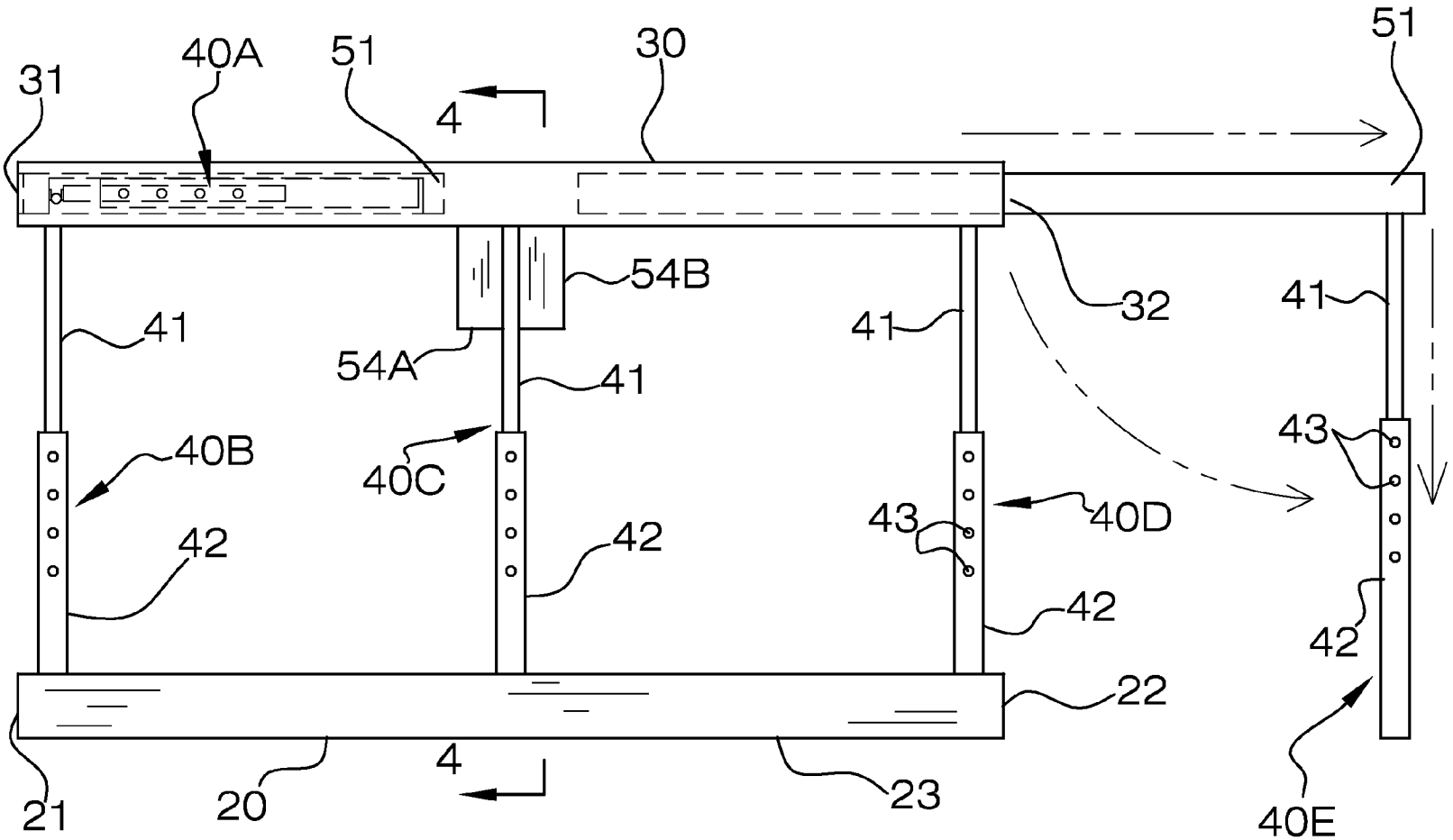
FIG. 3 is a front elevation view illustrating one horizontal member with telescoping leg slideably inserted into the upper support, one horizontal member with telescoping leg extended from the upper support, with the second, third, fourth, and fifth legs extended vertically.

Referring to FIG. 3, the plurality of orifices 43 is disposed horizontally within the outer member 42 of each telescoping leg. The plurality of pegs 44 is selectively and removably disposed within the orifices 43 thereby allowing a user to position the inner member 41 within the outer member 42, which adjusts leg height. Elevating leg height positions the upper support 30 higher above the base 20. Decreasing leg height positions the upper support 30 closer to the base 20.

Figure 6:
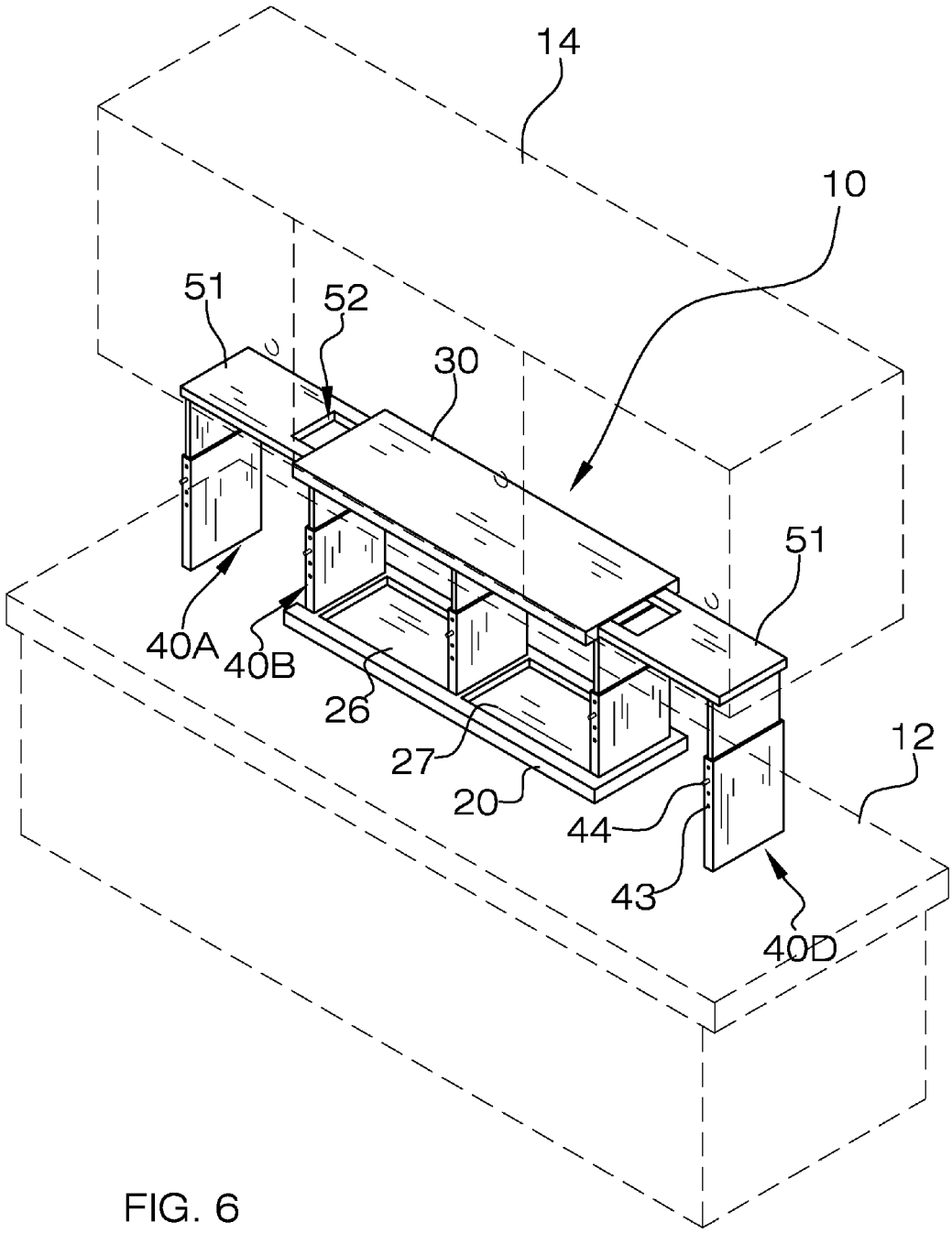
FIG. 6 is a perspective view of the apparatus positioned on top of existing lower cabinets and supporting existing upper cabinets.

Continuing to refer to FIGS. 1, 2, and 3, and referring also to FIG. 6, a horizontal member 51 with the first leg 40*a* is slideably disposed within the support first end 31. The first leg 40*a* is hingedly affixed laterally and downwardly to the horizontal member 51. The first leg 40*a* is selectively pivoted toward the upper support 30 and vertically downward. The support first end 31 horizontal member 51 thereby provides additional support laterally from the upper support 30, providing for supporting more additional upper cabinets 14 than would otherwise be possible. A horizontal member 51 with the fifth leg 40*e* is slideably disposed within the support second end 32. The fifth leg 40*e* is hinged laterally and downwardly to the horizontal member 51. The fifth leg 40*e* is selectively pivoted toward the upper support 30 and vertically downward, as chosen.

Figure 4:
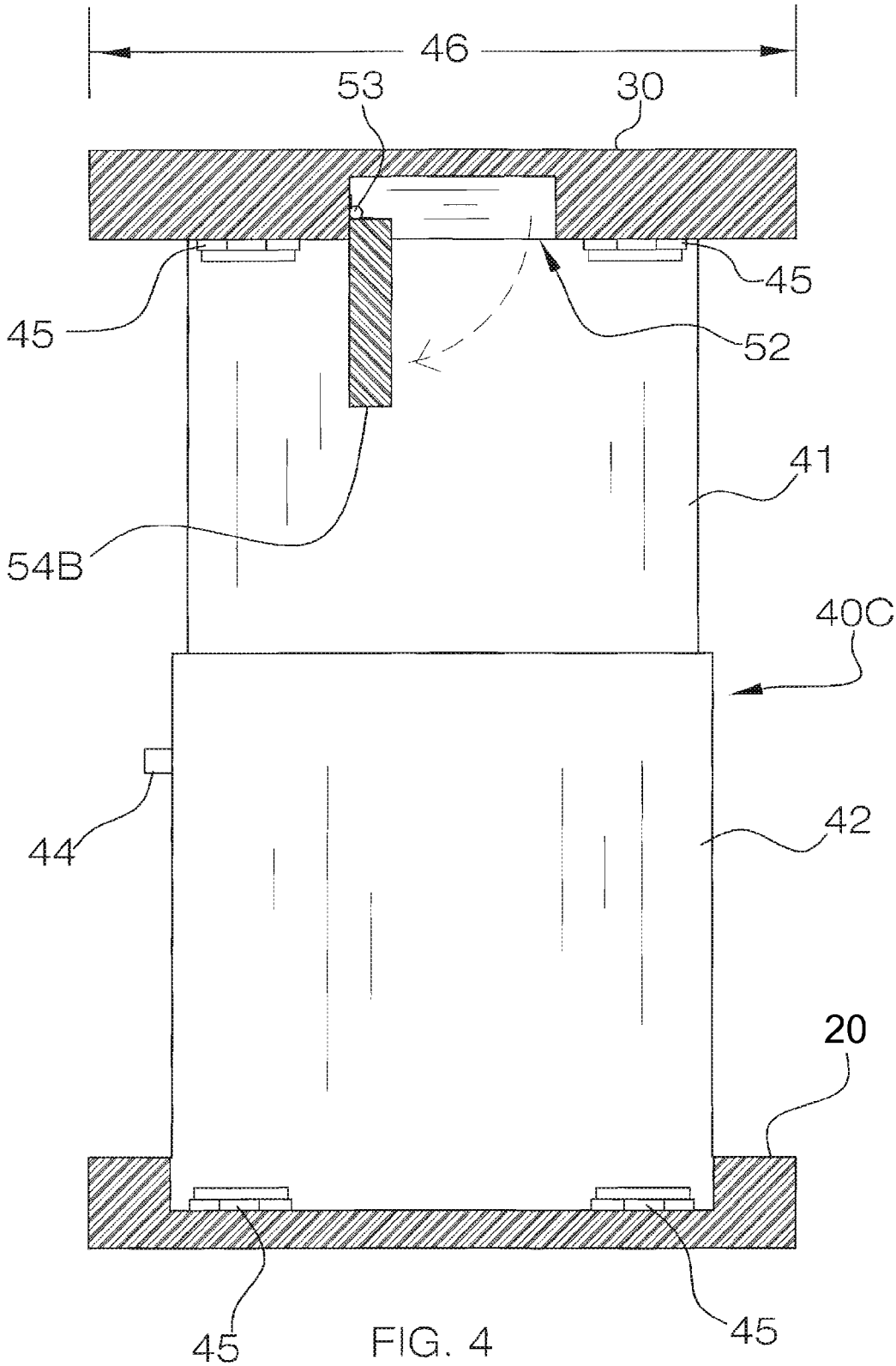
FIG. 4 is a cross sectional view of FIG. 3, taken along the line 4-4, the second stabilizing block pivoted downwardly and against the inner member of the third leg.

Referring to FIGS. 3 and 4, a cutout 52 is disposed medially within each horizontal member 51. A stabilizing block is hingedly disposed with each cutout 52 via a block hinge 53. Each block hinge 53 provides pivot of each stabilizing block from the cutout 52 to a vertically downward state. The first stabilizing block 54*a* is hingedly disposed within the support first end 31 of the upper support 30.

The second stabilizing block 54*b* is disposed within the support second end 32 of the upper support 30. Each stabilizing block is removably positioned against the third leg 40*c*, thereby stabilizing the upper support 30 against the third leg 40*c* to prevent lateral movement of the upper support 30 relative to the base 20.

Figure 5:
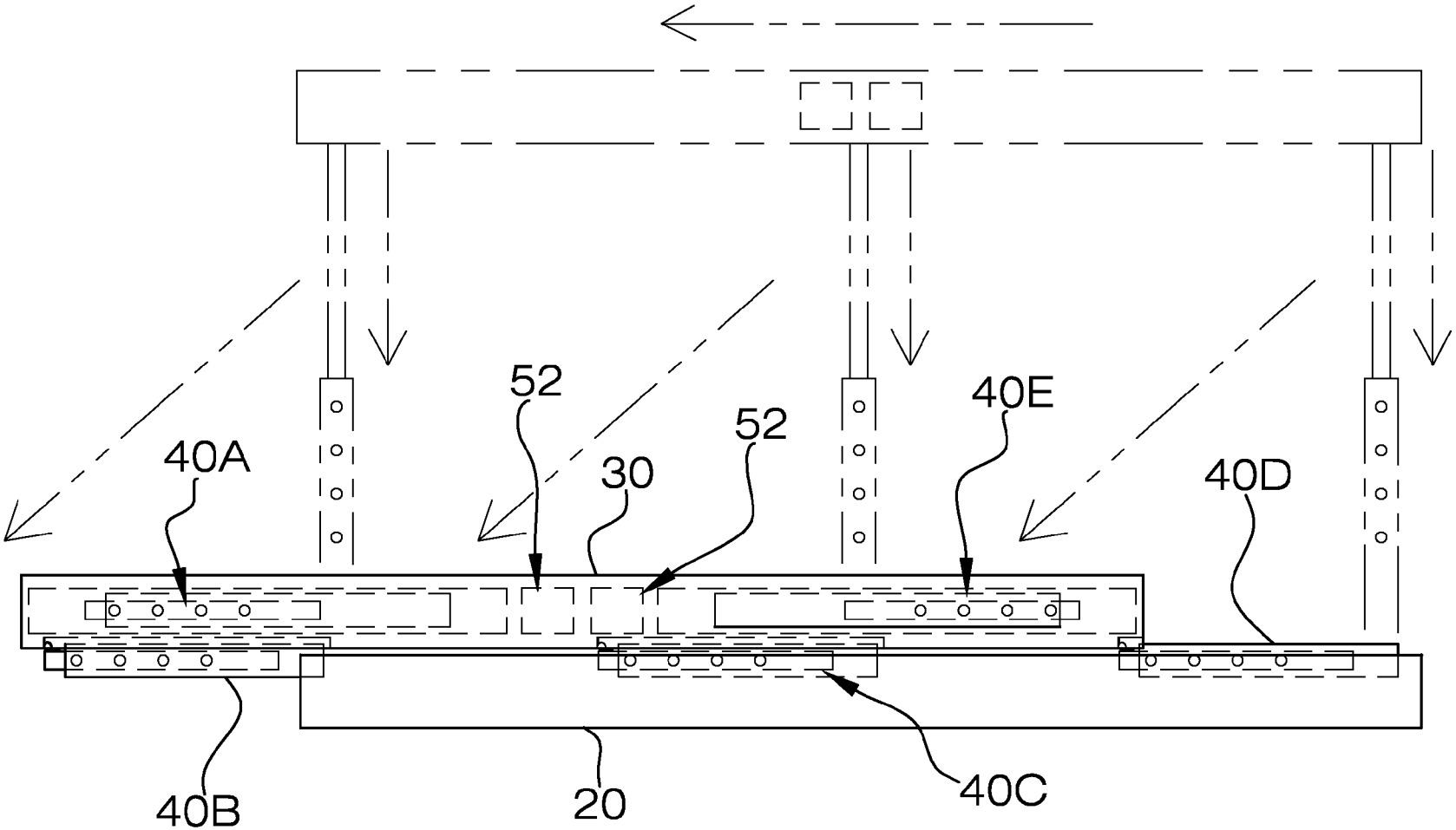
FIG. 5 is a front elevation view of the collapsibility of the apparatus.

Referring to FIG. 5, the collapsibility of the apparatus 10 is realized by sliding the horizontal members 51 with hinged telescoping legs back into the upper support 30. The second leg 40*b* pivots outwardly from the base 20 by allowance of the notch 28 in the base 20 first end 21 and by virtue of the leg hinges 45. The third leg 40*c* pivots selectively downward into the first recess 26 of the base 20. The fourth leg pivots selectively downward into the second recess 27. The upper support 30 thereby rests upon the base 20 for a compact collapsed size.

Referring to FIG. 6, the laterally outward support provided by the horizontal members 51 with telescopic legs provides for the apparatus 10 to support multiple existing upper cabinets 14 above the existing lower cabinets 12.

With respect to the above description then, it is to be realized that the optimum dimensional relationships for the parts of the collapsible workpiece support apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the collapsible workpiece support apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the collapsible workpiece support apparatus may be used.

Therefore, the foregoing is considered as illustrative only of the principles of the collapsible workpiece support apparatus. Further, since numerous modifications and changes will readily occur to those skilled in the art, it is not desired to limit the collapsible workpiece support apparatus to the exact construction and operation shown and described, and accordingly, all suitable modifications and equivalents may be resorted to, falling within the scope of the collapsible workpiece support apparatus.

What is claimed is:

1. A collapsible workpiece support apparatus comprising, in combination:

a rectangular horizontal base having a first end spaced apart from a second end, a front spaced apart from a rear, and a center;

a first recess disposed upwardly within the base, the first recess disposed between the center and the first end;

a second recess disposed upwardly within the base, the second recess disposed between the center and the second end;

a notch disposed within the base first end;

a rectangular horizontal upper support having a support first end spaced apart from a support second end, a support front spaced apart from a support rear, the support first end coplanar with the base first end, the support second end coplanar with the base second end, the support front coplanar with the base front, the support rear coplanar with the base rear;

a trio of spaced apart telescopic legs, the legs attaching the base to the upper support, each of the legs hingedly attached to the base and to the upper support via a one leg hinge on the base and one leg hinge on the upper support;

means for adjusting a height of the telescopic legs;

a pair of stabilizing blocks comprising a first stabilizing block and a second stabilizing block, the first stabilizing block selectively pivoted downward from the upper support to contact one of the telescopic legs adjacent to the base center, the first stabilizing block slightly more proximal to the base first end and the support first end, the second stabilizing block selectively pivoted downward to contact the same telescopic leg, the second stabilizing block slightly more proximal to the base second end and the support second end;

whereby an upward pivot of the stabilizing blocks allows the hinged telescopic legs to be positioned in a horizontal state, thereby allowing the upper support to collapse against the base.

2. The apparatus according to claim 1 wherein the means for adjusting the height of the telescopic legs further comprises an inner member slideably disposed within an outer member; and means for selectively positioning the inner member within the outer member.

3. The apparatus according to claim 2 wherein the means for selectively positioning the inner member within the outer member further comprises a plurality of orifices disposed vertically within the telescoping leg outer members; and a plurality of pegs removably disposed within the orifices.

4. The apparatus according to claim 1 wherein each telescopic leg further comprises a leg length from proximal to the base front and support front to proximal to the base rear and support rear.

5. The apparatus according to claim 2 wherein each telescopic leg further comprises a leg length from proximal to the base front and support front to proximal to the base rear and support rear.

6. The apparatus according to claim 3 wherein each telescopic leg further comprises a leg length from proximal to the base front and support front to proximal to the base rear and support rear.

7. A collapsible workpiece support apparatus comprising, in combination:

a rectangular horizontal base having a first end spaced apart from a second end, a front spaced apart from a rear, and a center;

a first recess disposed upwardly within the base, the first recess disposed between the center and the first end;

a second recess disposed upwardly within the base, the second recess disposed between the center and the second end;

a notch disposed within the base first end;

a rectangular horizontal upper support having a support first end spaced apart from a support second end, a support front spaced apart from a support rear, the support first end coplanar with the base first end, the support second end coplanar with the base second end, the support front coplanar with the base front, the support rear coplanar with the base rear;

a quintet of telescopic legs, the legs comprising a first leg, a second leg, a third leg, a fourth leg, and a fifth leg, the second leg, the third leg, and the fourth leg attaching the base to the upper support, each of the second leg, third leg, and fourth leg hingedly attached to the base and to the upper support via a one leg hinge on the base and one leg hinge on the upper support, the legs comprising the second leg disposed adjacent to the base first end and the support first end, the second leg selectively pivoted outwardly in the base notch, the third leg disposed at the base center, the fourth leg disposed proximal to the base second end and the support second end;

means for adjusting a height of the telescopic legs;

a horizontal member hingedly attached to the first leg, the horizontal member and first leg slideably disposed within the support first end, the first leg hinged laterally to the horizontal member, the first leg selectively pivoted toward the upper support and vertically downward;

a horizontal member hingedly attached to the fifth leg, the horizontal member with fifth leg slideably disposed within the support second end, the fifth leg hinged laterally to the horizontal member, the fifth leg selectively pivoted toward the upper support and vertically downward;

a cutout disposed medially within each horizontal member;

a first stabilizing block hingedly disposed with each cutout via a block hinge, the block hinge providing pivot of each stabilizing block from the cutout to a vertically downward state, each stabilizing block removably positioned against the third led, thereby stabilizing the upper support against the third leg.

8. The apparatus according to claim 7 wherein each telescopic leg further comprises a leg length from proximal to the base front and support front to proximal to the base rear and support rear.

9. A collapsible workpiece support apparatus comprising, in combination:

a rectangular horizontal base having a first end spaced apart from a second end, a front spaced apart from a rear, and a center;

a first recess disposed upwardly within the base, the first recess disposed between the center and the first end;

a second recess disposed upwardly within the base, the second recess disposed between the center and the second end;

a notch disposed within the base first end;

a rectangular horizontal upper support having a support first end spaced apart from a support second end, a support front spaced apart from a support rear, the support first end coplanar with the base first end, the support second end coplanar with the base second end, the support front coplanar with the base front, the support rear coplanar with the base rear;

a quintet of telescopic legs, the legs comprising a first leg, a second leg, a third leg, a fourth leg, and a fifth leg, the second leg, the third leg, and the fourth leg attaching the base to the upper support, each of the second leg, third leg, and fourth leg hingedly attached to the base and to the upper support via a one leg hinge on the base and one leg hinge on the upper support, each telescoping leg comprising an inner member slideably disposed within an outer member, each telescoping leg having a leg length from proximal to the base front and support front to proximal to the base rear and support rear, the legs comprising the second leg disposed adjacent to the base first end and the support first end, the second leg selectively pivoted outwardly in the base notch, the third leg disposed at the base center, the fourth leg disposed proximal to the base second end and the support second end;

a plurality of orifices disposed horizontally within the telescoping leg outer members;

a plurality of pegs removably disposed within the orifices whereby a position of the inner member within the outer member is selectively chosen;

a horizontal member hingedly attached to the first leg, the horizontal member and the first leg slideably disposed within the support first end, the first leg hinged laterally to the horizontal member, the first leg selectively pivoted toward the upper support and vertically downward;

a horizontal member hingedly attached to the fifth leg, the horizontal member and the fifth leg slideably disposed within the support second end, the fifth leg hinged laterally to the horizontal member, the fifth leg selectively pivoted toward the upper support and vertically downward;

a cutout disposed medially within each horizontal member;

a first stabilizing block hingedly disposed with each cutout via a block hinge, the block hinge providing pivot of each stabilizing block from the cutout to a vertically downward state, each stabilizing block removably positioned against the third leg, thereby stabilizing the upper support against the third leg.

* * * * *